United States Patent [19]

Tazawa

[11] Patent Number: 4,527,498

[45] Date of Patent: Jul. 9, 1985

[54] WORK-FEED MECHANISM FOR A SEWING MACHINE

[75] Inventor: Souichi Tazawa, Nagoya, Japan

[73] Assignee: Brother Kogyo Kabushiki Kaisha, Nagoya, Japan

[21] Appl. No.: 589,275

[22] Filed: Mar. 12, 1984

[30] Foreign Application Priority Data

Mar. 18, 1983 [JP] Japan ..... 58-40063[U]

[51] Int. Cl.[3] ..... D05B 27/02

[52] U.S. Cl. ..... 112/323; 112/311

[58] Field of Search ..... 112/310, 311, 323, 321

[56] References Cited

U.S. PATENT DOCUMENTS

| | | | |
|---|---|---|---|
| 1,770,870 | 7/1930 | Windram | 112/310 |
| 1,947,380 | 2/1934 | Christensen et al. | 112/323 |
| 1,988,400 | 1/1935 | Thompson | 112/323 |

FOREIGN PATENT DOCUMENTS 57-166194 10/1982 Japan .

*Primary Examiner*—Werner H. Schroeder
*Assistant Examiner*—Andrew M. Falik
*Attorney, Agent, or Firm*—Browdy & Neimark

[57] ABSTRACT

A work-feed mechanism for a sewing machine, comprising a two-arm actuating lever pivotably supported on a feed dog or on a member movable with the feed dog, and a lower feed needle supported on one of two arms of the lever and movable through a slot in a throat plate, between its lower and upper positions at which the upper end of the needle is below and above the upper surface of the throat plate, upon pivotal movements of the lever. The lever has, at the other arm, a portion adapted to abut on a portion or member provided on the lower surface of the throat plate upon upward movement of the feed dog. The lever is biased in a direction to cause the needle to move toward its lower position.

9 Claims, 8 Drawing Figures

WORK-FEED MECHANISM FOR A SEWING MACHINE

BACKGROUND OF THE INVENTION

The present invention relates generally to a work-feed mechanism for a sewing machine having a feed dog which is operable to effect four-motion movements to feed a workpiece or workpieces in cooperation with a presser foot. More particularly, the invention is concerned with such a work-feed mechanism having a lower feed needle which is operated in timed relation with the feed dog.

In the art of such type of work-feed mechanism, a work-feed device is known, wherein a lower feed needle is attached to a feed dog. However, this device suffers a problem when a workpiece to be sewn is relatively thick. To solve this problem, there has been proposed a device which is disclosed in TOKU-KAI-SHO 57-166194 (Japanese patent application laid open Oct. 13, 1982 under Publication No. 57-166194), wherein a feed bar carrying a feed dog is provided with a lower feed needle which is movable relative to the feed dog. A movement to the lower feed needle is imparted from a feed-lift mechanism (for imparting a vertical movement to the feed dog) via plural pivotable levers provided on the feed bar. This arrangement makes it possible to obtain a vertical displacement of the lower feed needle larger than that of the feed dog, thus effectively preventing a relative horizontal displacement between the opposite surfaces of a workpiece or superposed workpieces even when the total thickness of the workpiece(s) is large.

However, the proposed work-feed device referred to just above still suffers a problem. That is, a linkage for imparting the relative movements to the lower feed needle uses a large number of parts, and the linkage is connected to the feed-lift mechanism to give said relative movements to the lower feed needle. Such linkage arrangement of the proposed work-feed device requires a considerable degree of modification of the feed-lift mechanism of a sewing machine, to provide the machine with such a work-feed device.

SUMMARY OF THE INVENTION

It is accordingly an object of the present invention to provide a work-feed mechanism which is simple in construction, and highly capable of preventing a relative horizontal displacement between the opposite surfaces of a workpiece or workpieces with a wide variety of thicknesses, from the thinnest to the thickest. Another object of the invention is to provide such a work-feed mechanism which is built in a sewing machine with minimum modification of the latter.

According to the present invention, there is provided a work-feed mechanism for a sewing machine having a sewing needle and a throat plate with an elongate slot. The instant mechanism comprises:

movable means including a feed dog operable through the slot in the throat plate to feed a workpiece on the throat plate, and a feed bar carrying the feed dog;

means for imparting a four-motion movement to the movable means;

an actuating lever pivotably supported on the movable means and having first and second arms;

a lower feed needle supported on the first arm of the actuating lever and disposed to be movable through the slot between its lower and upper positions with its upper end rising and falling from the upper surface of the throat plate upon pivotal movements of the actuating lever;

engaging means provided on the lower surface of the throat plate and located opposite to the second arm of the actuating lever for abutting contact with the same upon upward movement of the movable means; and biasing means for urging the actuating lever in a direction to cause the lower feed needle to move toward its lower position.

In the work-feed mechanism constructed as described above, upward and downward movements of the feed dog will cause the actuating lever to pivot with the second arm brought into abutting contact with the lower surface of the throat plate or a member provided thereon. This pivotal movement of the actuating lever gives the lower feed needle a comparatively large amount of movement relative to the feed dog, thus enabling the feed needle to penetrate or pierce the workpiece or workpieces through the entire total thickness even when it is relatively large.

Further, the acutating lever is operated by means of a simple structure as indicated above, that is, a feed-needle device of the instant work-feed mechanism is simple in construction, and consequently requires minimum modification of feed-advance and feed-lift mechanisms, whereby, the feed-needle device to operate the lower feed needle can be readily built in a sewing machine.

BRIEF DESCRIPTION OF THE DRAWINGS

The above and other objects, features and advantages of the present invention will be better understood from reading the following description of the preferred embodiments taken in connection with the accompanying drawings in which.

DETAILED DESCRIPTION OF THE PREFERRED EMBODIMENTS

Referring first to FIGS. 1–4, a first embodiment of a work-feed mechanism of the invention will be described.

Figure 1:
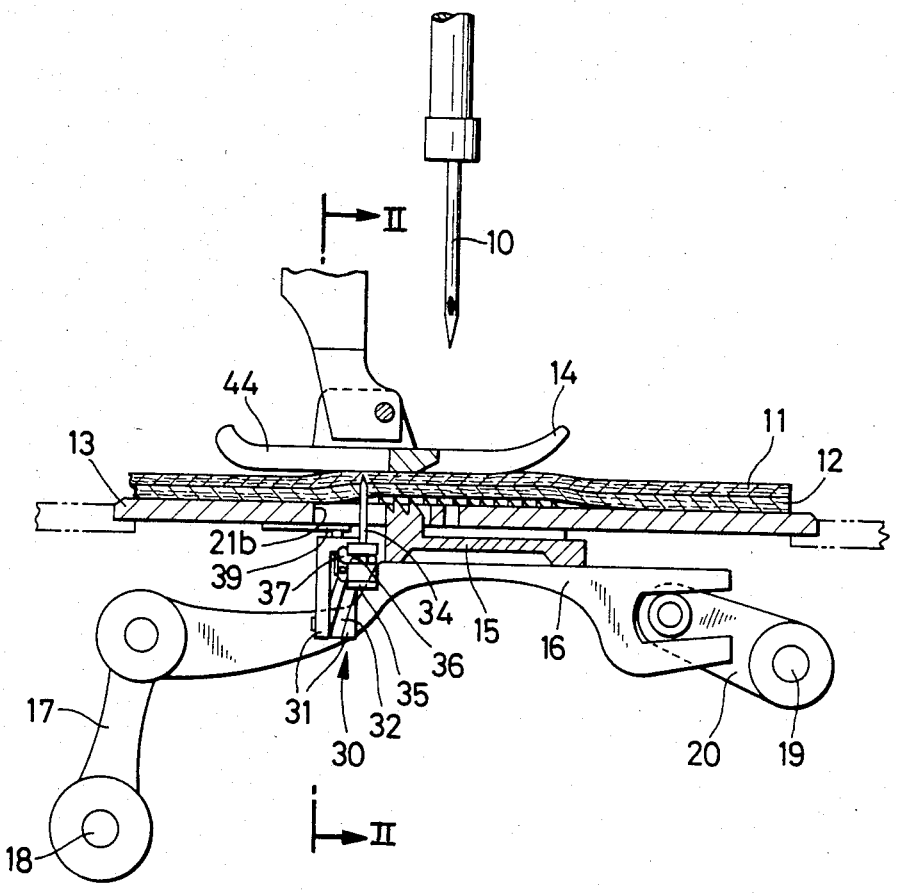
FIG. 1 is a fragmentary view in cross section of a first embodiment of a work-feed mechanism of the invention, showing the work-feed mechanism while its feed dog is placed in its upper position.

There are shown, in FIG. 1, a sewing needle 10, two workpieces 11 and 12 superposed one on another to be stitched together with the needle 10, and a presser foot 14 which is resiliently biased by a known presser device to press the workpieces 11, 12 against the throat plate 13. Below the throat plate 13, there is disposed a feed bar 16 which carries a feed dog 15. The feed bar 16 is connected, at its left end, to a horizontal-feed or feed-advance rock shaft 18 via a feed-advance rocker arm 17, and at its bifurcated right end, engages a free end of a feed-lift rocker arm 20 fixed to a vertical-feed or feed-lift rock shaft 19. With this arrangement, a known four-motion movement is imparted to the feed dog 15 which operates through three elongate guide slots 21*a*, 21*b* and 21*c* formed in parallel rows in the throat plate 13, and cooperates with the presser foot 14 to feed the workpieces 11, 12 in intermittent timed relation to the vertical reciprocating movements of the needle 10. Thus, the feed-advance and feed-lift rock shafts 18 and 19, rocker arms 17 and 20, etc. constitute means for imparting the four-motion movement to the feed bar 16 and feed dog 15 which are provided as movable means.

There will be described next a feed-needle operating device 30 provided on the feed bar 16 for accurate feeding of the workpieces being stitched.

Figure 3:
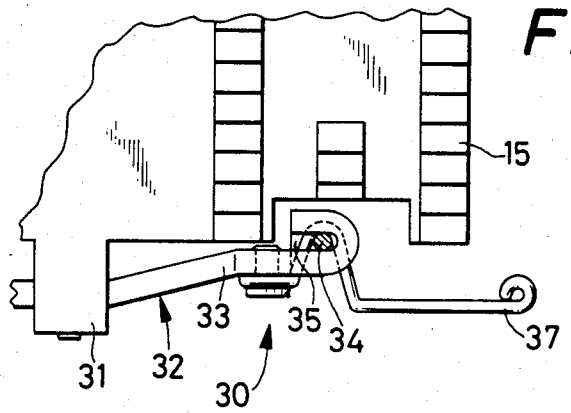
FIG. 3 is an enlarged view showing a structure for holding a lower feed needle provided in the mechanism.

The feed bar 16 has a support portion 31 which is located behind the rear end of the feed dog 15 and extends downwardly. On the support portion 31 is pivotably supported a generally V-shaped actuating lever 32 which has first and second arms 33 and 38. A free end of the first arm 33 is turned as shown in FIG. 3. The turned end of the first arm 33 is provided at its lower part with a needle support plate 35 which bears a lower feed needle 34. The turned end of the first arm 33 has a groove 36 in which is accommodated a bent portion of a curved spring 37. This spring 37 is fixed at its one end to the turned end of the first arm 33, and the other end extends rightwardly to provide a free end portion at which the spring 37 is operated by the operator. The bent portion of the spring 37 cooperates with an inner surface of the turned end of the arm 33 to hold the lower end portion of the lower feed needle 34 with a resilient force thereof. The needle 34 is removable by moving the free end of the spring 37 upwardly in FIG. 3.

Figure 2:
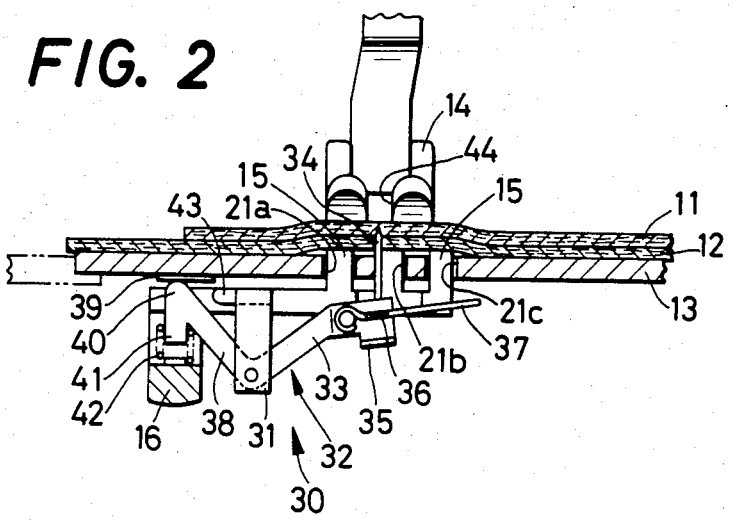
FIG. 2 is a cross sectional view taken along line II—II of FIG. 1.
Figure 4:
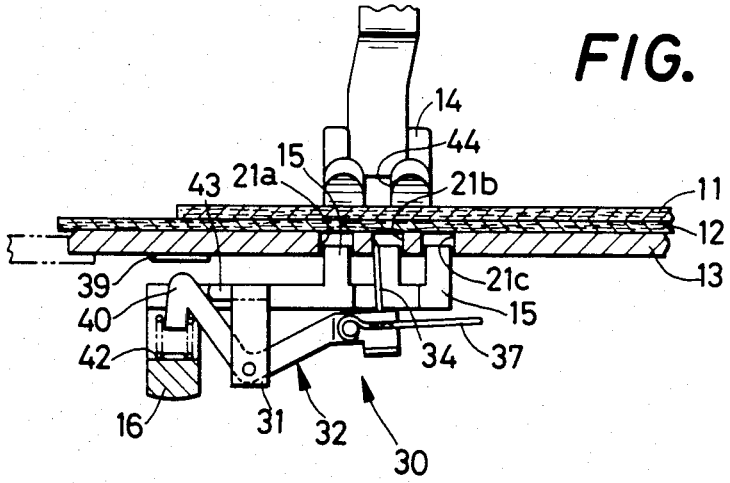
FIG. 4 is a cross sectional view showing the work-feed mechanism of FIG. 1 while its feed dog is placed in its lower position.

The second arm 38 of the actuating lever 32 is formed with an abutting portion 40 which is adapted to abut on an engaging portion 39 provided on the lower surface of the throat palte 13. The second arm 38 is further provided with a downward extension 41 extending downwardly from the abutting portion 40. Biasing means in the form of a coil spring 42 is interposed between the downward extension 41 of the second arm 38 and a part of the feed bar 16 opposite to the extension 41, so that the actuating lever 32 is biased by the coil spring 42 in a direction that causes the lower feed needle 34 on the first arm 33 to fall or move down away from the upper surface of the throat plate 13 toward its lower position, that is, the lever 32 is biased in the clockwise direction as viewed in FIG. 2. As illustrated in FIGS. 2 and 4, the support portion 31 of the feed bar 16 is provided at its upper part with a stopper tab 43 extending leftwardly therefrom. This stopper tab 43 is engageable with the second arm 38 of the actuating lever 32 and thus serves as stopper means for stopping or limiting a pivotal movement of the lever 32 caused by a resilient force of the coil spring 42, i.e., to determine the lower position of the lower feed needle 34 while the feed dog 15 is located below the upper surface of the throat plate 13 as shown in FIG. 4.

As clearly shown in FIGS. 2 and 4, the lower feed needle 34 is disposed in pressed contact with an inner left side surface of the middle elongate guide slot 21*b* which extends in a direction of feed of the workpieces 11, 12. The guide slot 21*b* is formed perpendicularly to the plane of the throat plate 13, that is, the left side surface and the opposite right side surface which define the guide slot 21*b* are perpendicular to the throat plate. The presser foot 14 has an opening 44 which is so disposed as to accommodate the upper portion of the lower feed needle 34 and thereby prevents an interference of the same with the presser foot 14 when the needle 34 rises to its upper position while being guided along the inner left side surface of the guide slot 21*b*.

The operation of the first embodiment of the work-feed mechanism constructed as discussed hitherto will be described below.

When the sewing machine is started to stitch the workpieces 11, 12 to each other, the sewing needle 10 is reciprocataed endwise. Concurrently, the feed-advance and feed-lift rock shafts 18 and 19 are operated in a rocking fashion, whereby the feed dog 15 is given a four-motion movement in a predetermined timed relation to the reciprocating movements of the needle 10.

While the feed dog 15 is located below the upper surface of the throat plate 13 as shown in FIG. 4, the lower feed needle 34 is inclined at a slight angle with respect to a line perpendicular to the throat plate 13, with its upper portion held in pressed contact with the inner left side surface of the guide slot 21*b*, while the abutting portion 40 of the actuating lever 32 is held spaced from the engaging portion 39. Upon upward movement of the feed dog 15 from this position, the actuating lever 32 is moved upward together with the feed dog 15 and without a pivotal movement thereof until the abutting portion 40 comes into abutting contact with the engaging portion 39. Upon abutment of the abutting portion onto the engaging portion 39, the actuating lever 32 is pivoted relative to the feed dog 15 in the counterclockwise direction as seen in FIG. 4. In response to this pivotal movement of the actuating lever 32, the lower feed needle 34 engaging the inner wall surface of the guide slot 21*b* is forced to change its posture against a spring force of the curved spring 37, from its slightly inclined position to its upright position at which the needle 34 is perpendicular to the throat plate 13. In the meantime, the counterclockwise pivotal movement of the actuating lever 32 will cause the lower feed needle 34 to move upward relative to the feed dog 15, whereby the feed needle 34 pierces the workpieces 11, 12, as shown in FIG. 2, at a speed sufficiently higher than a rising speed of the feed dog 15. In other words, the actuating lever 32, engaging portion 39 and other members are dimensioned and shaped so that the piercing action of the lower feed needle 34 to penetrate the workpieces 11, 12 will take place concurrently with the projecting action of the feed dog 15 from the upper surface of the throat plate 13.

When the lower feed needle 34 has been elevated a further distance from the position of FIG. 2 to its upper position and completed its penetration through the total thickness of the workpieces 11, 12, the rising movement of the feed dog 15 is changed into a horizontal advance movement to feed the workpieces 11, 12 to the left from the position of FIG. 1. At the end of the horizontal advance movement, the feed dog 15 starts its downward movement, allowing the actuating lever 32 to be pivoted clockwise under the action of the coil spring 42, and returned to its original position. With the clockwise pivotal movement of the actuating lever 32, the lower feed needle 34 is moved downward relative to the feed dog 15 away from the workpieces 11, 12 at a speed sufficiently higher than a lowering speed of the feed dog 15. When the feed dog 15 has been located below the upper surface of the throat plate 13 at the end of its downward movement, the feed needle 34 is located at its lower position at which the upper end of the needle 34 is completely distant from the workpieces 11, 12, as illustrated in FIG. 4. In this condition, the feed dog 15 is horizontally moved in the reverse direction, and thus one cycle of four-motion movement of the feed dog 15 is completed. The four-motion cycle including the penetration of the feed needle 34 through the workpieces is repeated while a sewing operation is conducted on the workpieces 11, 12 to stitch them together. Thus, the lower feed needle 34 cooperates with the feed dog 15 to assure accurate intermittent feeding movements of the upper and lower workpieces 11, 12 without a relative horizontal displacement between the two workpieces 11, 12.

In the above first embodiment of the work-feed mechanism, the lower feed needle 34 is brought into its upright operating position by means of pressed engagement or contact thereof with the vertical inner wall surface of the guide slot 21*b*, which serves as guiding means for guiding the initially inclined needle 34 into its upright position. Therefore, the instant work-feed mechanism does not require special means for guiding the needle 34 in a direction perpendicular to the throat plate 13 in which the guide slot 21*b* is formed. Thus, the present embodiment is advantageous in that the mechanism is available without structural complexity. The instant work-feed mechanism is further advantageous in its arrangement by which the needle 34 is easily removable from the actuating lever 32, i.e., can be changed from one to another with extreme ease.

Figure 5:
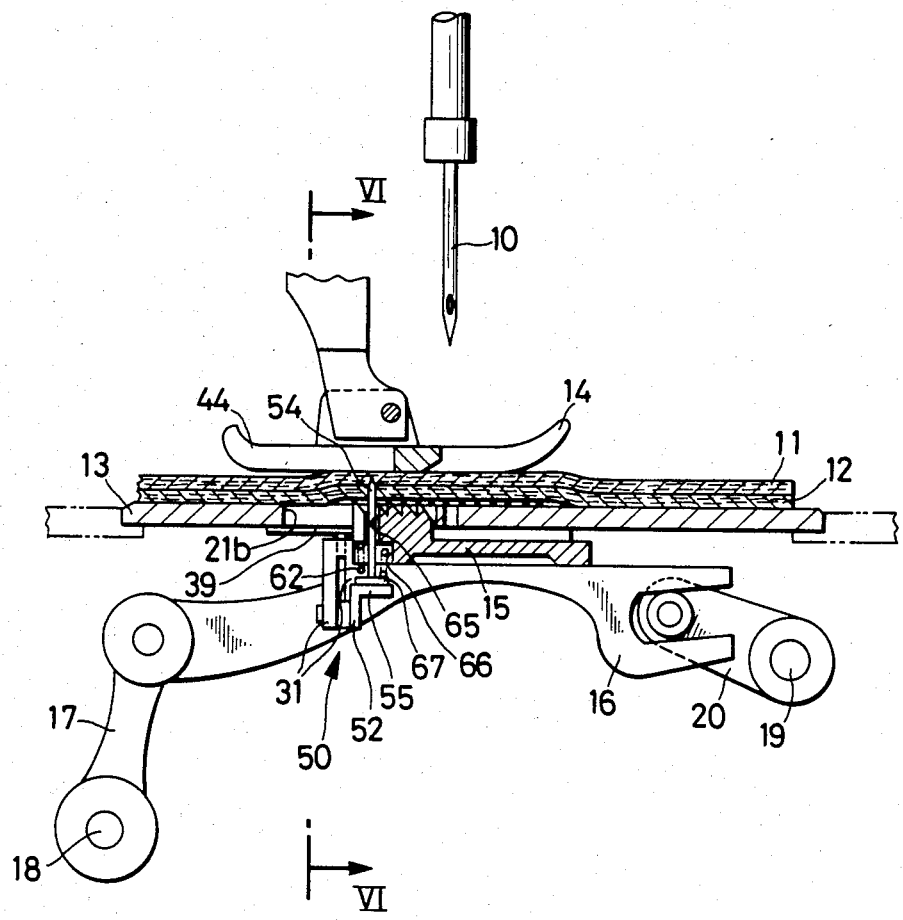
FIG. 5 is a fragmentary view in cross section corresponding to FIG. 1, showing a second embodiment of the invention.
Figure 6:
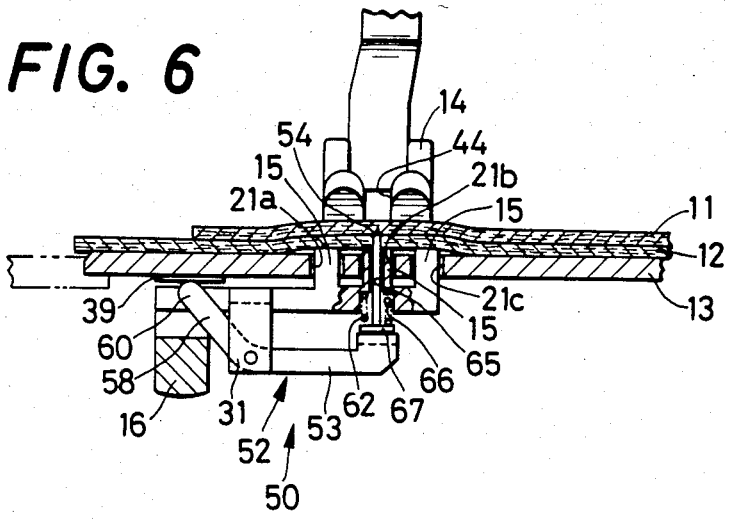
FIG. 6 is a cross sectional view taken along line VI—VI of FIG. 5.
Figure 7:
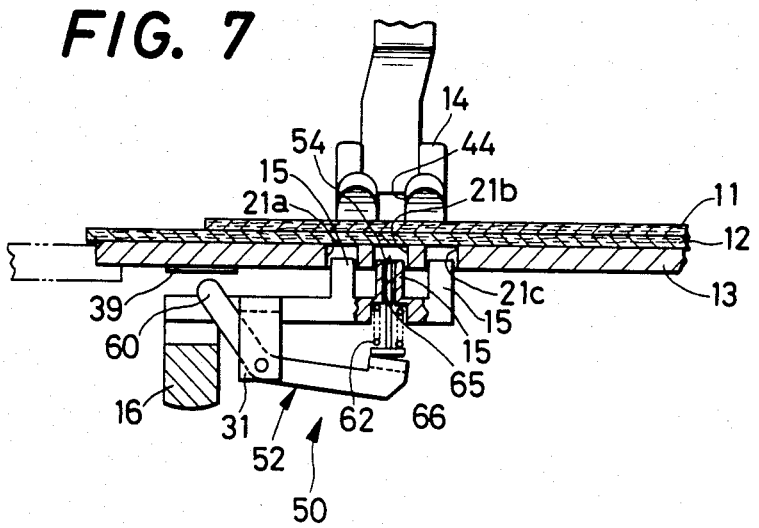
FIG. 7 is a cross sectional view corresponding to FIG. 4.

Referring next to FIGS. 5–7, there is shown a second embodiment of the invention, wehrein the same reference numerals are used to identify the corresponding parts.

The second embodiment is provided with a similar feed-needle operating device 50 also disposed on the feed bar 16. The support portion 31 at the rear of the feed dog 15 pivotably supports a generally V-shaped actuating lever 52 which has two arms 53 and 58. The arm 53 has, at its free end, a stepped needle-support portion 55 to bear a lower feed needle 54 at its lower end, and the other arm 58 has at its free end an abutting portion 60 which is engageable in abutting contact with the engaging portion 39 provided on the lower surface of the throat plate 13.

The feed dog 15 has a through-hole 65 which is formed so as to extend in a vertical direction perpendicular to the throat plate 13 and in aligned relation with the opening 44 formed in the presser foot 14. The lower feed needle 34 is inserted in this through-hole 65 and guided thereby so as to move in the vertical direction. The feed dog 15 is provided, in its lower surface, with a recess 66 which communicates with the through-hole 65. A coil spring 62 is interposed, as biasing means, between an upper wall surface of the recess 66 and a support 67 fixed to the lower end of the feed needle 54. The actuating lever 52 is biased by the coil spring 62 in a direction that causes the upper end of the needle 54 to fall toward its lower position, that is, in the clockwise direction as viewed in FIG. 6. While the feed dog 15 is located below the upper surface of the throat plate 13 as depicted in FIG. 7, a pivotal movement of the actuating lever 52 caused by the coil spring 62 is limited by means of engagement of the second arm 58 with the support portion 31 of the feed bar 16. Thus, the support portion 31 serves as stopper means corresponding to the stopper tab 43 of the preceding embodiment.

The thus constructed work-feed mechanism in this second preferred embodiment of the invention is operated in the following manner.

When the sewing machine is started and the feed dog 15 is elevated from its lower position shown in FIG. 7, the actuating lever 52 is moved upward together with the feed dog 15 and without a pivotal movement thereof until the abutting portion 60 comes into abutting contact with the engaging portion 39. Upon abutment of the abutting portion 60 onto the engaging portions 39, the actuating lever 52 is pivoted in the counterclockwise direction as seen in FIG. 7. In response to this pivotal movement of the actuating lever 52, the lower feed needle 54 is moved upward relative to the feed dog 15 while being guided by the through-hole 65, at a speed sufficiently higher than the rising speed of the feed dog 15, as in the first embodiment. As a result, the lower feed needle 54 pierces the workpieces 11, 12, as shown in FIG. 6. At the end of the upward movement of the feed dog 15, the feed needle 54 has been elevated a further distance from the position of FIG. 6 to its upper position, thereby penetrating through the total thickness of the workpieces 11, 12. Then, the rising movement of the feed dog 15 is changed into a horizontal advance movement to feed the workpieces 11, 12.

When the feed dog 15 is moved downward after completion of the horizontal advance movement, the actuating lever 52 is pivoted relative to the feed dog 15 under the action of the coil spring 62 in the clockwise direction. With the clockwise pivotal movement of the actuating lever 52, the lower feed needle 54 is moved downward away from the workpieces 11, 12 at a speed sufficiently higher than a lowering speed of the feed dog 15. When the feed dog 15 has been located below the upper surface of the throat plate 13 at the end of its downward movement, the feed needle 54 is located at its lower position at which the upper end of the needle 34 is completely distant from the workpieces 11, 12, as illustrated in FIG. 7. In this condition, the feed dog 15 is horizontally moved in the reverse direction, and thus one cycle of four-motion movement of the feed dog 15 is completed. This four-motion cycle is repeated while a sewing operation is conducted on the workpieces 11, 12 to stitch them together. Thus, the lower feed needle 54 cooperates with the feed dog 15 to prevent otherwise possible relative horizontal displacement between the two workpieces 11, 12 during their feeding, thereby assuring formation of beautiful stitches on the workpieces.

While the two embodiments of the invention have been described, it is to be understood that the invention is not limited thereto but may be otherwise embodied with various changes and modifications without departing from the scope of the invention.

For example, while the actuating lever 32, 52 of the preceding embodiments is provided on the feed bar 16 such that it is supported by the support portion 31 provided on the feed dog 15, it is possible that the actuating lever 32, 52 be pivotably supported directly by the feed bar 16.

It is further possible that the engaging portion 39 be a separately manufactured member made of a synthetic resin and supported fixedly or removably on the lower surface of the throat plate 13. This separate plastic engaging member is preferred because of its property of reducing an impact noise which may be generated upon abutment thereof on the abutting portion 40, 60 of the actuating lever 32, 52.

Figure 8:
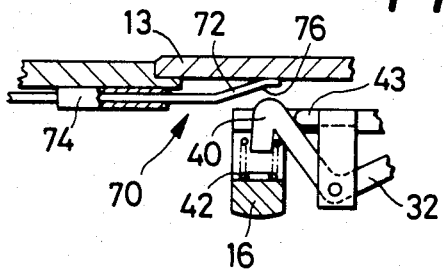
FIG. 8 is a fragmentary cross sectional view of a modified form of a work-feed mechanism according to the invention.

Further, it is possible that the separate engaging member be tapered on its lower or abutting surface, and adapted to be slidable along the lower surface of the throat plate 13 so that the level of abutting contact between the engaging member and the abutting portion 40, 60, i.e., a vertical position of the former relative to the latter, can be changed to vary the upper positions of the lower feed needle 34, 54 and of the feed dog 15, that is, to adjust a distance of projection of the lower feed needle 34, 54 from the upper surface of the throat plate 13 when the lower feed needle 34, 54 is placed in its upper position. For example, the engaging portion 39 may be formed by a bent end portion 72 of an adjusting plate 70 which is adapted to be slidable along the lower surface of the throat plate 13, as shown in FIG. 8. The adjusting plate 70 is supported by a guide 74 so that the adjusting plate 70 is slidable in a direction perpendicular to the direction of feed of the workpiece. In this arrangement, the end portion 72 is movable relative to the abutting portion 40 of the actuating lever 32 in a direction parallel to the throat plate 13. The bent end portion 72 has a tapered surface 76 which is inclined so as to approach the lower surface of the throat plate 13 from its proximal end toward its distal end, that is, the tapered surface 76 nears the throat plate 13 as it extends toward the feed dog 15. This tapered surface 76 is adapted to engage the abutting portion 40. Accordingly, a position of engagement between the tapered surface 76 and the abutting portion 40 can be changed by moving the adjusting plate 70 to a desired position along the throat plate 13, whereby it is possible to adjust, from zero to a predetermined maximum, a distance of projection of the lower feed needle 34 from the upper surface of the throat plate 13 while the needle 13 is placed in its upper position. Alternatively, the bend end portion 72 having the tapered surface, may be replaced by an end portion which has two or more stepped surfaces which correspond to two or more values of projecting distance of the lower feed needle increasing in steps from minimum zero to maximum. In this instance, the adjusting plate is moved so that the appropriate stepped surface is aligned with the abutting portion 40 of the actuating lever 32.

Although the abutting portion 40, 60 of the previous embodiments is not held in abutting engagement with the engaging portion 39 while the feed dog 15 is in its lower position, it is appreciated that the actuating lever 32, 52 be adapted for permanent abutment of the abutting portion 40, 60 on the engaging portion 39.

As is apparent from the foregoing description, a work-feed mechanism according to the invention is characterized by an actuating lever which is pivotably supported on a feed bar and which has two arms, one arm supporting a lower feed needle and the other arm including an abutting portion which is held in abutting engagement with or adapted to abut on the lower surface of a throat plate, the actuating lever being disposed so as to permit the lower feed needle to move between its lower and upper positions with its upper end rising and falling from the surface of the throat plate through a guide slot formed in the throat plate, the actuating lever being biased by a resilient member in a direction that causes the lower feed needle to move toward its lower position, whereby the lower feed needle is moved up and down at a high speed, to penetrate the workpieces in timed relation to upward and downward movements of the feed dog, thus preventing a horizontal relative displacement between the opposite surfaces of workpieces of a wide variety of thicknesses. In the instant work-feed mechanism, the vertical movements of the lower feed needle are obtained by means of abutment of one arm of the actuating lever on the lower surface of the throat plate. Thus, a feed-needle operating device of the work-feed mechanism is simple in construction, and consequently requires minimum modification of feed-advance and feed-lift mechanisms. In other words, the work-feed mechanism can be readily built in a sewing machine. Further, the actuating lever and the feed dog or feed bar are available as an assembly unit wherein the lever is operatively connected to the feed dog or feed bar. This assembly unit further facilitates the attachment of the feed-needle operating device to the sewing machine.

What is claimed is:

1. A work-feed mechanism for a sewing machine having a sewing needle and a throat plate with an elongate slot, comprising:

movable means including a feed dog operable through said slot to feed a workpiece on said throat plate, and a feed bar carrying said feed dog;

means for imparting a four-motion movement to said movable means;

an actuating lever pivotably supported on said movable means and having two arms;

a lower feed needle supported on one of said two arms and disposed to be movable through said slot between its lower and upper positions with its upper end rising and falling from the upper surface of said throat plate upon pivotal movements of said actuating lever;

engaging means provided on the lower surface of said throat plate and located opposite to the other of said two arms for abutting contact with the same upon upward movement of said movable means; and biasing means for urging said actuating lever in a direction to cause said lower feed needle to move toward said lower position thereof.

2. A work-feed mechanism according to claim 1, wherein said lower feed needle is supported by an elastic member associated with said one arm of the actuating lever, and disposed to be held in pressed contact with one of side surfaces defining said slot extending in a direction of feed of said workpiece, said one side surface being perpendicular to said throat plate, thereby guiding said lower feed needle in a direction perpendicular to said throat plate.

3. A work-feed mechanism according to claim 2, wherein said elastic member has a portion at which said lower feed needle is operated to remove the same from said one arm of the actuating lever.

4. A work-feed mechanism according to claim 1, wherein said feed dog has a hole extending in a direction perpendicular to said throat plate, said lower feed needle moving through said hole between said lower and upper positions thereof.

5. A work-feed mechanism according to claim 1, said engaging means comprises a member secured to the lower surface of said throat plate.

6. A work-feed mechanism according to claim 1, further comprising means for adjusting a distance of projection of said lower feed needle from the upper surface of said throat plate when said lower feed needle is placed in said upper position thereof.

7. A work-feed mechanism according to claim 6, wherein said engaging means is a member supported on the lower surface of said throat plate movably in a direction parallel to said throat plate to change a position thereof relative to said other arm in a direction perpendicular to said throat plate when said lower feed needle is placed in said lower position thereof.

8. A work-feed mechanism according to claim 7, wherein said member is tapered on its surface opposite to said other arm.

9. A work-feed mechanism according to claim 1, further comprising stopper means for stopping the pivotal movement of said actuating lever caused by said biasing means, and thereby determining said lower position of said lower feed needle.

* * * * *